US009487991B2

(12) United States Patent
Deiss et al.

(10) Patent No.: US 9,487,991 B2
(45) Date of Patent: Nov. 8, 2016

(54) STRIP-SHAPED SUPPORT AND INSULATING ELEMENT FOR SUPPORTING AND INSULATING A WINDOW FRAME

(71) Applicant: ISO-Chemie GmbH, Aalen (DE)

(72) Inventors: Martin Deiss, Abtsgmuend (DE); Andreas Lange, Urbach (DE)

(73) Assignee: Iso-Chemie GmbH (DE)

( * ) Notice: Subject to any disclaimer, the term of this patent is extended or adjusted under 35 U.S.C. 154(b) by 0 days.

(21) Appl. No.: 14/602,223

(22) Filed: Jan. 21, 2015

(65) Prior Publication Data

US 2015/0211285 A1 Jul. 30, 2015

(30) Foreign Application Priority Data

Jan. 24, 2014 (EP) ..... 14152543

(51) Int. Cl.

*E06B 3/273* (2006.01)
*E06B 1/58* (2006.01)
*E06B 1/00* (2006.01)
(Continued)

(52) U.S. Cl.

CPC ..... *E06B 1/58* (2013.01); *E06B 1/003* (2013.01); *E06B 1/36* (2013.01); *E06B 1/62* (2013.01); *E06B 3/2632* (2013.01); *E06B 3/273* (2013.01); *E06B 1/60* (2013.01); *E06B 2001/626* (2013.01); *E06B 2001/707* (2013.01); *E06B 2003/26321* (2013.01); *E06B 2003/26349* (2013.01)

(58) Field of Classification Search

CPC ..... E06B 1/58; E06B 3/273; E06B 3/2632; E06B 1/62; E06B 1/36; E06B 1/003; E06B 2003/26349; E06B 2003/26321; E06B 2001/707; E06B 1/60; E06B 2001/626

USPC ..... 52/210, 204.5, 214, 204.591, 204.66, 52/204.1

See application file for complete search history.

(56) References Cited

U.S. PATENT DOCUMENTS 6,105,973 A * 8/2000 Butler et al. ..... 277/644
2007/0056230 A1* 3/2007 Bren ..... 52/204.1

FOREIGN PATENT DOCUMENTS

CA 2365140 A1 * 6/2003
DE 19701582 A1 * 1/1998
(Continued)

OTHER PUBLICATIONS

Miczek Alois Jun. 14, 2007 Machine Translate for DE102005058732—From EPO website.*
(Continued)

*Primary Examiner* — Babajide Demuren
(74) *Attorney, Agent, or Firm* — Jansson Munger McKinley & Kirby Ltd.

(57) ABSTRACT

A strip-shaped support and insulating element for supporting and insulating a window frame with respect to a main wall includes: (1) a support part formed of load-bearing material and having (a) a first side surface engageable with the main wall and (b) a second side surface substantially perpendicular to the first side surface and supportingly engageable with the window frame, the support part including (a1) a first web that includes the first side surface and an inner side surface opposite the first side surface and (a2) a second web connected to and projecting at an angle from the first web; and (2) an insulating part along the inner side surface of the first web and pivotably connected to an outer edge area of one of the first and second webs such that the insulating part is pivotable between positions which expose or cover the inner side surface of the first web.

14 Claims, 5 Drawing Sheets

(51) Int. Cl.

| | |
|---|---|
| ***E06B 1/36*** | (2006.01) |
| ***E06B 3/263*** | (2006.01) |
| *E06B 1/60* | (2006.01) |
| *E06B 1/62* | (2006.01) |
| *E06B 1/70* | (2006.01) |

(56) References Cited

FOREIGN PATENT DOCUMENTS

| | | | | | |
|---|---|---|---|---|---|
| DE | 4123647 | B4 | * | 3/2004 | |
| DE | 102004038246 | A1 | | 5/2006 | |
| DE | 102005058732 | A1 | * | 6/2007 | |
| EP | 1811111 | A2 | * | 7/2007 | ..... E06B 1/64 |
| EP | 2639394 | A2 | | 9/2013 | |
| GB | 2389124 | A | | 12/2003 | |

OTHER PUBLICATIONS

Tremco Illbruck Prod GmbH [DE], Jun. 17, 2013 Machine Translate for DE202012002491—From EPO website.*

* cited by examiner

STRIP-SHAPED SUPPORT AND INSULATING ELEMENT FOR SUPPORTING AND INSULATING A WINDOW FRAME

FIELD OF THE INVENTION

The invention relates to elements for supporting and insulating window frames.

BACKGROUND OF THE INVENTION

Support and insulating elements have been used for some years in conjunction with composite thermal insulation systems to extend a wall opening for a window artificially outward. According to EP 2 639 394 A2, a support part of rigid, load-bearing foam is screwed laterally to the wall and serves, especially at the bottom, to support the window frame to be inserted. In this composite thermal insulation system, an outer face wall, for example, cooperates with the inner wall to form an intermediate space, in which the support part is arranged. The load-bearing support part with a more-or-less triangular cross-section is supplemented by an insulating part, which consists of, for example, a hard, flexible foam and which cooperates with the support part to form a two-part body with preferably a rectangular cross-section. After the support part has been screwed to the inner wall, the insulating part must be joined to the support part in a separate operation.

It is an object of the present invention to provide a support and insulating element which can be transported and installed especially easily.

SUMMARY OF THE INVENTION

According to an aspect of the invention, the strip-shaped support and insulating element for supporting and insulating a window frame comprises a support part having a first side surface extending in a longitudinal direction, which first side surface serves to rest against the main wall to which the support part is to be attached, and a second side surface, extending in the longitudinal direction, which is substantially perpendicular to the first side surface and serves to support the window frame, wherein the support part is made of a load-bearing material. The support part comprises a first web, which includes the first side surface, and also comprises a second web, which is connected to the first web and projects from the first web at an angle. In addition, the support and insulating element comprises an insulating part, which is connected to the support part. The insulating part is arranged in an area of an inner side surface of the first web of the support part opposite the first side surface and is pivotably connected to an outer edge area of the first or second web in such a way that the insulating element is pivotable between a working position, in which it exposes at least most of the inner side surface of the first web of the support part, and an insulating position, in which it covers at least most of the inner side surface of the first web of the support part.

With this configuration, a combined support and insulating element is created, which can be transported compactly and installed especially easily. This is ensured first by the fact that the support part and the insulating part are connected to each other, and second by the fact that the insulating part can be pivoted away from the support part, so that the inner side surface of the first web of the support part is exposed to allow the production of through-holes for the fastening means and to allow the introduction of the fastening means into the through-holes for attachment of the support and insulating element to the main wall. Then the insulating part can be easily pivoted back into the insulating position, in which it fulfills its insulating function.

The pivotable connection between the insulating part and the support part is preferably formed by a flexible adhesive strip, which is adhered to both the insulating part and the support part. In this way, a low-cost and easy-to-handle structure is created, which allows the insulating part to pivot with respect to the support part to any desired degree.

To further facilitate the on-site installation work, it is possible for at least one through-hole extending through the first web of the support part from the inner side surface of the first web to the first side surface to accommodate a fastening element for fastening the support part to the main wall to have been already provided in the web. In this way, the tradesman does not need to perform the step of producing the through-hole at the construction site.

In a preferred embodiment, the support part is made of a rigid foam material. This material has the advantage that it can bear a great deal of weight but also performs a certain insulating function on its own. An example of a corresponding material is a rigid foam based on polyurethane such as Purenit®.

The insulating part is preferably formed of foam, preferably of a hard, flexible foam. This foam material should preferably be self-supporting. Thermal insulation materials such as polystyrene, Styrodur, Styropor, Styrofoam, or Neopur can be considered for this use, for example.

To improve the fastening of the insulating part to the support part during transport and also in the installed state, the one of the first and second webs, to which the insulating part is not pivotably connected, can be connected to the insulating part by an adhesive strip which can be pulled off at least from the support part.

An especially preferred geometry is given when the support part has a substantially L-shaped cross-section. This guarantees that the pivoting of the insulating part is not impeded and simultaneously that slanted surfaces on the support part, which would make it more difficult to produce through-holes or to introduce fastening elements into the through-holes, are avoided.

In a more complex variant, the support part can have a substantially T-shaped cross-section. Then the support and insulating element comprises preferably two insulating parts, one on each side of the second web.

In most of the preferred embodiments, the second web comprises the second side surface, and the first and second side surfaces also intersect at the same angle at which the second web projects from the first web. This pertains in particular to the configuration of the support part with an L-shaped cross-section.

It is also possible, however, for the first web to comprise the second side surface, which is then arranged adjacent to the first side surface. This configuration is unavoidable in the case of a support part with a T-shaped cross-section, but it can also be present in the case of the support part with an L-shaped cross-section.

The latter configuration is especially advantageous when a sealing strip of a flexible foam which returns to its original shape after compression is arranged on a side of the insulating part facing away from the support part. In this way, the sealing action of the insulating part is reinforced, for the flexible foam can, because of its expansive force, rest under pressure against the outer wall. In the case of the configuration of the support part with a T-shaped cross-section, furthermore, it is also possible for the flexible foam to conform to the window frame and to seal it off against the effects of weather.

To facilitate handling in such a case, the sealing strip is preferably held in the compressed state by a compression means, wherein, by loosening or removing the compression means, the expansion of the sealing strip can be initiated. Thus the compression means can be loosened or removed only after the support and insulating element has been installed, and the sealing strip, the expansion of which would interfere with the work of installing the support and insulating element, will not expand until after that work is completed.

In a preferred embodiment, the compression means is a plastic sheet wrapper, which at least partially surrounds the sealing strip. It can be easily loosened or removed and can also serve in the installed state as a vapor barrier. Alternatively, the sealing strip can also be configured in such a way that the expansion can be activated in a controlled manner by, for example, the effect of heat, by the effect of moisture, or by the effect of electricity.

A building section equipped with support and insulating elements according to the invention usually comprises a main wall, an outer wall, and an intermediate space between the main wall and the outer wall. The support and insulating elements, as they were described above, are usually arranged in the intermediate space between the main wall and the outer wall and are fastened to the main wall by fastening elements. A window frame is arranged adjoining the intermediate space and rests on the second side surfaces of the support part of the support and insulating elements. It is also possible for only one support and insulating element to be present, which is arranged underneath the window frame and thus bears the weight of the window. As an alternative to the outer wall, it is also possible to attach a layer of thermal insulation comprising an opening for a window to the main wall. The support and insulating element will then project into this thermal insulation layer.

BRIEF DESCRIPTION OF THE DRAWINGS

Additional advantages and properties of the support and insulating element according to the invention can be derived from the following description, which refers to the drawings:

FIGS. 1*a* and 1*b* are cross-sectional views of a first embodiment of the support and insulating element according to the invention, wherein FIG. 1*b* illustrates the insulating part during the pivoting process.

FIGS. 4*a* and 4*b* are cross-sectional views of another embodiment of the support and insulating element according to the invention, wherein FIG. 4*b* shows the insulating part during the pivoting process.

DETAILED DESCRIPTION OF SPECIFIC EMBODIMENTS

Figure 1A:
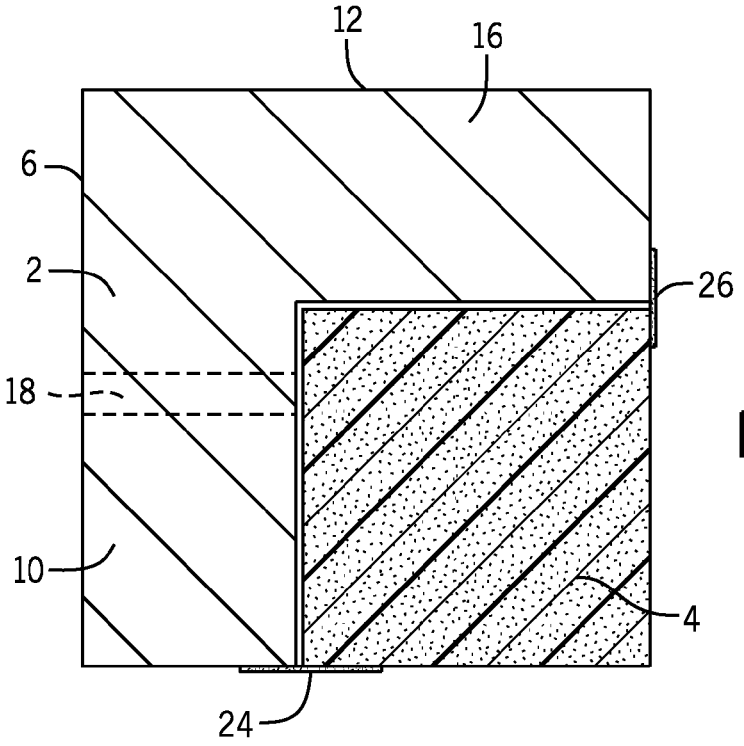
Figure 1B:
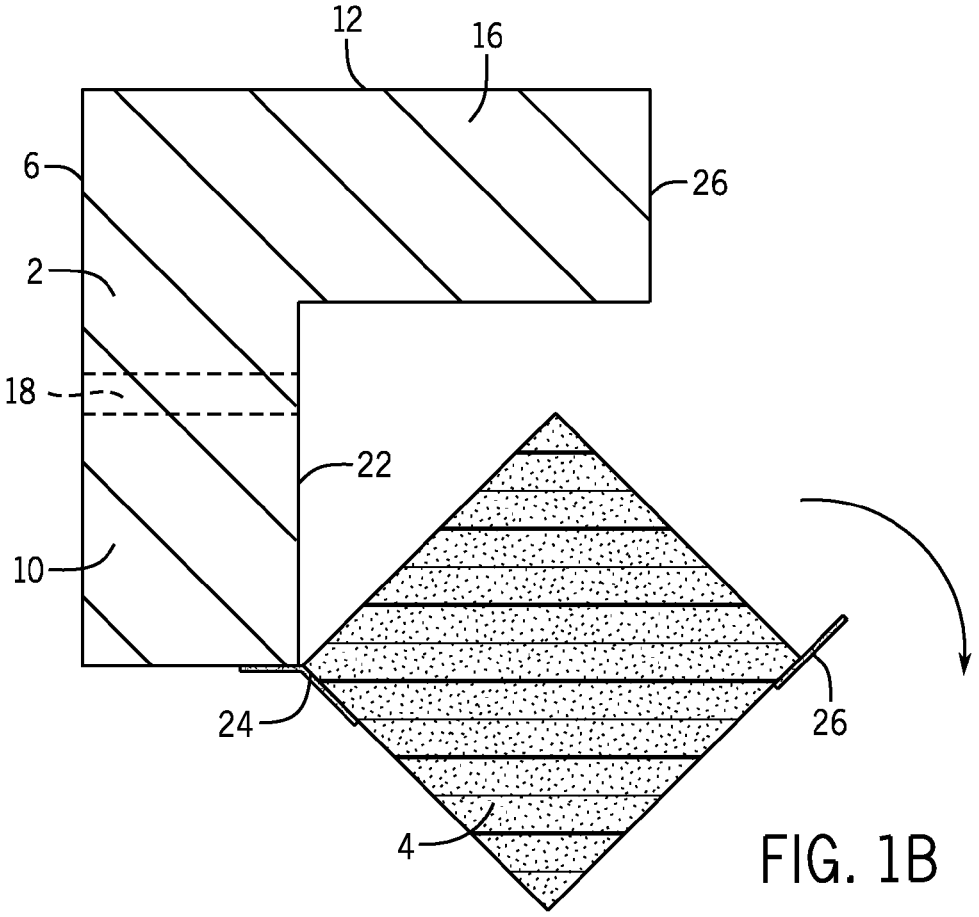

FIGS. 1*a* and 1*b* show a first embodiment of the support and insulating element according to the invention for supporting and insulating a window frame. The support and insulating element comprises a support part 2 with an angled cross-section, to which an insulating part 4 with a rectangular cross-section is connected. As can best be seen in FIG. 3, both the support part 2 and the insulating part 4 extend primarily in a longitudinal direction. The length of the support and insulating element in the longitudinal direction can be freely selected and is preferably in the range of 10-150 cm. The support part 2 can be formed as a single piece or consist of two smaller parts connected together. The support part 2, in the embodiment shown here, has an L-shaped cross-section. It is made of a load-bearing material, which is adapted to bear the weight of the window frame without itself becoming deformed. Wood or plastic can be used as the material of the support part 2, but a rigid foam material, such as a foam based on polyurethane or polystyrene, for example, is preferred.

It is preferable for the rigid foam material to comprise a compressive stress according to DIN EN 826 in the range of 2-15 MPa, and especially in the range of 4-8 MPa. The bulk density of the rigid foam material should be in the range of 100-1,200 kg/m$^3$, and preferably in the range of 350-800 kg/m$^3$. The thermal conductivity of the rigid foam material should be in the range of 0.05-0.2 W/mK, and preferably in the range of 0.06-0.15 W/mK. The rigid foam material is dimensionally stable and incompressible under the load of the window. An example of a rigid foam material of this type is sold under the name Purenit®.

Figure 2:
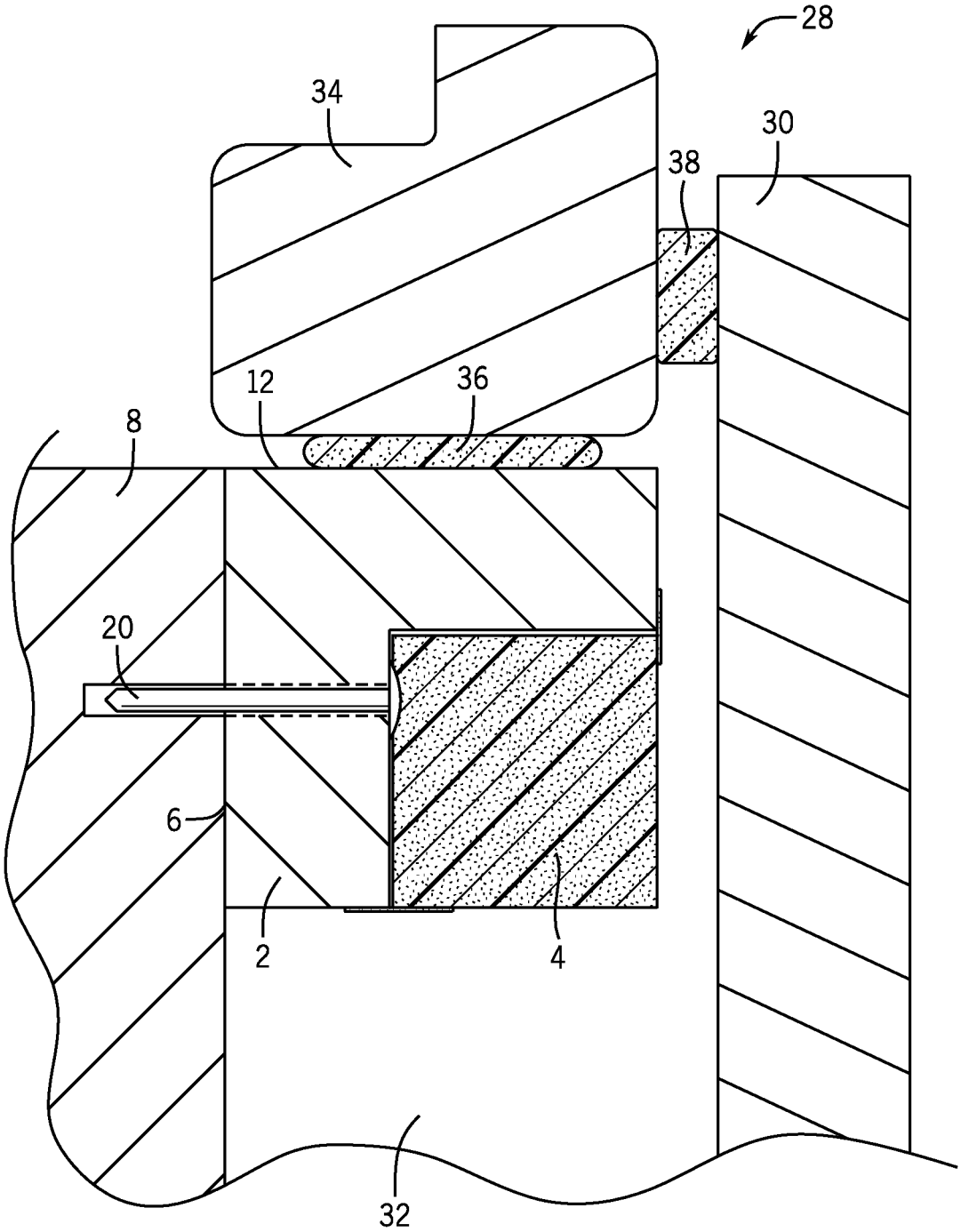
FIG. 2 is a schematic, cross-sectional view of a building section showing an installation situation of the support and insulating element of FIG. 1*a*.

The support part 2 comprises a first side surface 6, extending in the longitudinal direction, which serves to rest against the main wall 8 (FIG. 2). The first side surface 6 is part of a first web 10 of the support part 2. The support part 2 also comprises a second side surface 12, extending in the longitudinal direction, which second side surface 12 is substantially perpendicular to the first side surface 6 and serves to support a window frame 34 (FIG. 2). In the exemplary embodiment shown here, the second side surface 12 is part of a second web 16 of the support part 2, which is connected to the first web 10 and projects from the first web 10 at an angle. In the example shown here, the angle is 90°. The first side surface 6 and the second side surface 12 meet each other along one edge and also intersect at the same angle as the two webs 10, 16 do, therefore at an angle of 90°.

In the first web 10, one or preferably several through-holes 18 can be provided, which serve to allow the passage of one or more fastening elements 20 (FIG. 2), such as screws. Each through-hole 18 thus passes through the first web 10 of the support part 2 from an inner side surface 22, which is opposite the first side surface 6, to the first side surface 6. As can be seen in FIG. 2, each fastening element 20 serves to fasten the support part 2 of the support and insulating element to the main wall 8.

It is also possible to not provide any through-holes 18 in the first web 10 of the support part 2 at the factory; instead the through-holes in the support part 2 can be made by the tradesman only after the support and insulating element has arrived at the installation site.

The insulating part 4 is arranged in the area of the inner side surface 22 of the first web 10 of the support part 2. It is preferably made of foam, and more preferably of a hard, flexible foam. Generally, these types of foam materials are self-supporting but cannot bear any load. Examples of such materials are polystyrene, Styrodur, Styropor, Styrofoam, and Neopur, with unit weights of <100 kg/m$^3$, and preferably <50 kg/m$^2$. They are considered thermal insulation materials. The compressive strength of these thermal insulation materials is preferably no more than 50% of the compressive strength of the rigid, load-bearing foam preferably used for the support part 2. In fact, it is usually less than 20% of that value.

The insulating part 4 is pivotably connected to an outer edge area of the first web 10 of the support part 2. It can also be pivotably connected to an outer edge area of the second web 16 of the support part 2. FIG. 1*a* shows an insulating position of the insulating part 4, in which the insulating part 4 covers at least most of the inner side surface 22 of the first web 10 of the support part 2. In the present case, the insulating part 4 covers the inner side surface 22 completely. In this position, the insulating part 4 lies preferably both on the first web 10 and also on the second web 16 of the support part 2. It is especially preferable for the support part 2 and the insulating part 4 to form together a rectangular cross-section. The support and insulating element is also preferably transported in this insulating position.

FIG. 1*b* shows the insulating part 4 as it is being pivoted into a working position, in which it exposes at least most of the inner side surface 22 of the first web 10 of the support part 2. In the working position of the insulating part 4, the fastening elements 20 can be introduced without hindrance into the through-holes 18. If there are no through-holes 18 in the support part 2, the tradesman has unhindered access to the first web 10 of the support part 2 when the insulating part 4 is in the working position and can produce the through-holes 18 there before he introduces the fastening elements 20 through the through-holes 18 and into the main wall 8. The pivot angle between the working position and the insulating position of the insulating part 4 is usually in the range of 60-120° but is not subject to any limitations. The pivotable connection between the insulating part 4 and the support part 2 is preferably achieved by a flexible adhesive strip 24, which is adhered both to the insulating part 4 and to the support part 2. In the embodiment shown in FIGS. 1*a* and 1*b*, the adhesive strip 24 extends straight across the edge-to-edge joint between the support part 2 and the insulating part 4 and thus covers it. There are, however, many other arrangements of the adhesive strip 24 which can be considered.

In addition to the adhesive strip 24, the person skilled in the art will be able to imagine many other possibilities for realizing the pivoting connection between the insulating part 4 and the support part 2. For example, the insulating part 4 and the support part 2 could be connected to each other by another elastic element, a small area of the support part 2 could be laminated directly to the insulating part 4, or some other mechanical pivoting connection could be realized between the insulating part 4 and the support part 2.

In the embodiment illustrated in FIG. 1*a*, furthermore, a second adhesive strip 26 is provided, which connects the edge area of the second web 16 of the support part 2 to the insulating part 4. This adhesive strip 26 should be easily releasable at least from the support part 2, because it must be separated from the support part 2 before the insulating part 4 can be pivoted into the working position (FIG. 1*b*). The adhesive strip 26 is preferably reusable, so that, after the support part 2 has been fastened to the wall 8 and the insulating part 4 has been pivoted back into the insulating position, the strip can be refastened to the support part 2. Instead of the second adhesive strip 26, the releasable connection between the insulating part 4 and the second web 16 of the support part 2 can also be realized in some other way.

In the case where the pivotable connection is established between the second web 16 of the support part 2 and the insulating part 4, the releasable adhesive bond between the insulating part 4 and the support part 2 will logically be situated between the insulating part 4 and the first web 10 of the support part 2.

In principle, however, the pivotable connection between the insulating part 4 and the support part 2 can also be the only connection between these two components. The insulating part 4 should, in that case, remain in the insulating position as long as no external forces act on it. This would be possible, for example, if, through suitable choice of the size and shape of the support part 2 and of the insulating part 4, the insulating part 4 wedges itself, removably, between the inside surface of the support part 2 perpendicular to the inner side surface 22 and the pivoting connection.

The insulating part 4 can also be configured in such a way that the surface of the insulating part 4 adjoining the inner side surface 22 of the support element 2 provides sufficient free space to accommodate the parts of the fastening elements 20 which may be projecting from the inner side surface 22 (not shown in the drawings).

Figure 3:
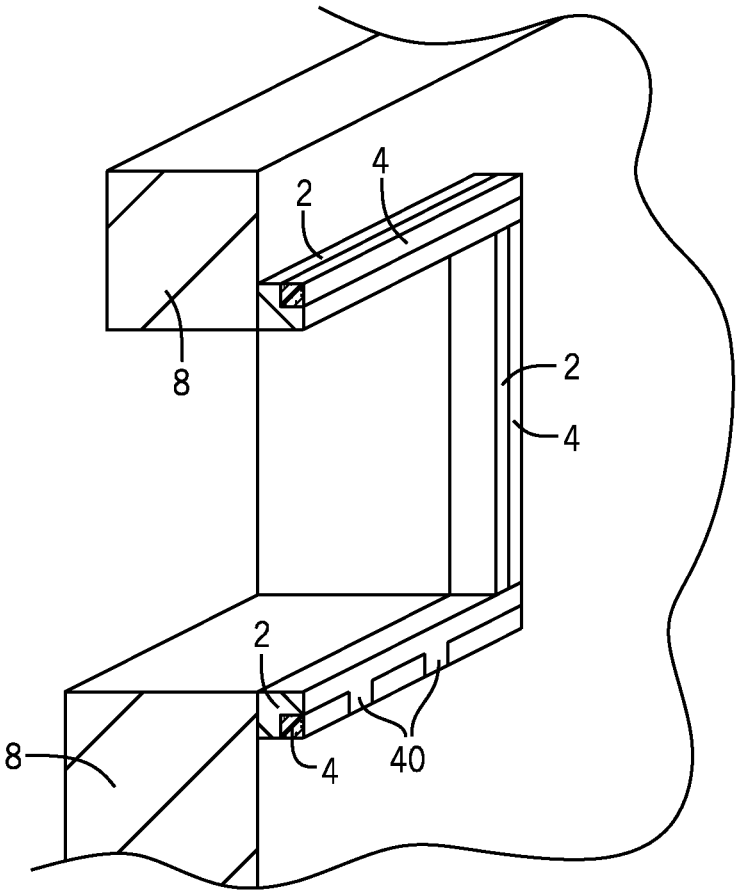
FIG. 3 is a schematic, perspective view of a window opening in a masonry wall with several support and insulating elements according to the invention placed around the window opening.

FIGS. 2 and 3 show the installation situation of a support and insulating element according to the invention. The building section 28 shown comprises not only the main wall 8, to which the support part 2 is fastened by means of the fastening elements 20, but usually also an outer wall 30, which is usually formed by thermal insulation material. This outer wall 30 is rear-ventilated, and the support and insulating element according to the invention is arranged in the intermediate space 32 between the main wall 8 and the outer wall 30. The outer wall 30 is usually connected to the main wall 8 by webs, projections, or bolts. The window frame 34 (FIG. 2) is usually arranged in line with the intermediate space 32 and is supported on the second side surface 12 of the support part 2 of the at least one support and insulating element. In addition, sealing elements 36 such as elements made of polyurethane foam can be inserted between the window frame 34 and the support part 2. Sealing elements 38 such as elements of polyurethane foam can also be arranged between the window frame 34 and a projection of the outer wall 30 extending up beyond the height of the support part 2.

As can be seen especially clearly in FIG. 3, the strip-shaped support and insulating elements are usually arranged all the way around the window opening (only three of four sides are shown). In this context, in should be pointed out that the orientation of the support and insulating elements in FIGS. 1*a*, 1*b*, 2, 4*a*, 4*b*, and 5 always represents the installation situation present under the window opening. The support and insulating element must be rotated as needed on the other three sides of the window opening.

It is also possible to install one or more support and insulating elements only under the window opening, because that is where the primary weight of the window rests.

If the window frame 34 is surrounded on all sides by support and insulating elements according to the invention, then the one or more support and insulating elements at the bottom of the window opening will usually be connected to the main wall 8 by screws or the like. At this location, but primarily on the other sides of the window opening, it is possible under certain conditions that an adhesive bond between the support part 2 and wall 8 could be sufficient. The adhesive bond can also be advantageous as a supplement to the fastening by means of the fastening elements 20. The adhesive can preferably also serve simultaneously as a vapor barrier.

In FIG. 3, the lengths of the support and insulating elements correspond to the corresponding length and width of the window opening. Nevertheless, it is also possible to arrange several support and insulating elements in a row along each side of the window opening. As a rule, the individual support and insulating elements will be mitered to the proper length and either will rest against each other or preferably will be fastened together, especially by means of an adhesive. A situation is also conceivable, however, in which the individual support and insulating elements do not butt up against each other and instead have intermediate spaces between them, which are filled up with other materials such as insulating materials.

As shown in FIG. 3, the support part 2 can comprise, in the bottom area of the window opening, additional projections 40, to which an exterior windowsill (not shown), for example, can be screwed. In addition, such projections 40 can also serve to improve the static load-bearing capacity of the support part 2.

Figure 4A:
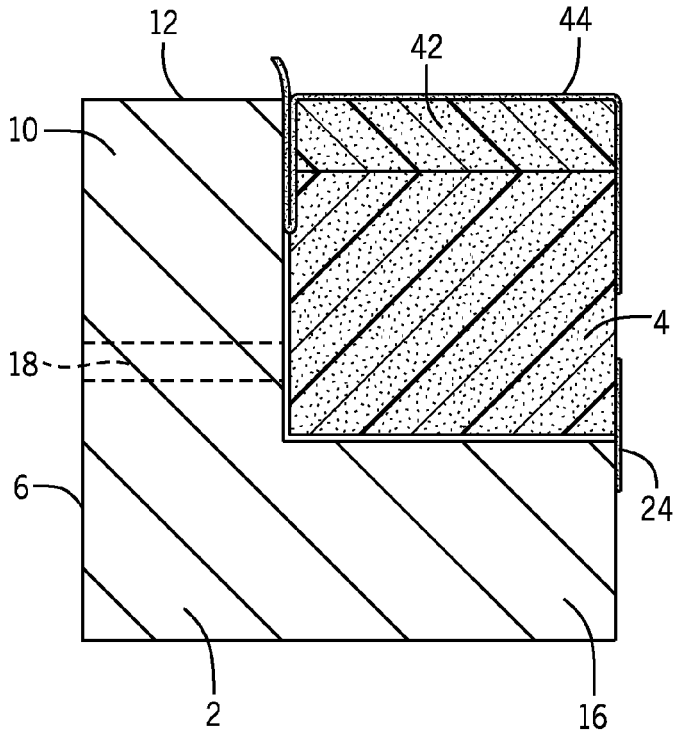
Figure 4B:
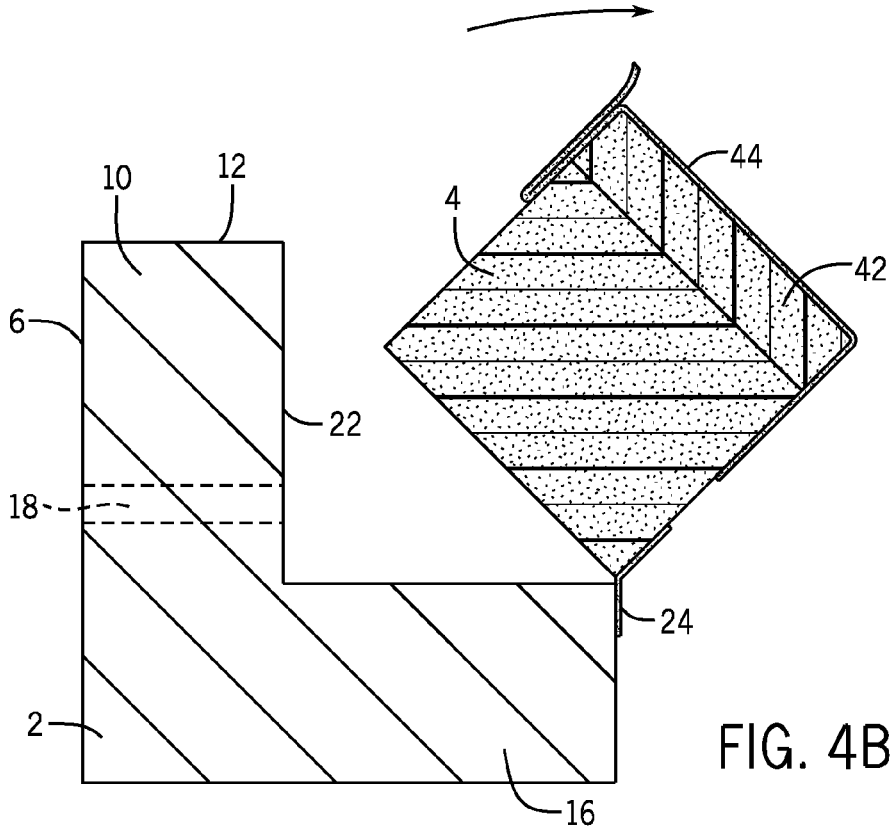

FIGS. 4*a* and 4*b* show a different embodiment of the support and insulating element according to the invention. Here the second side surface 12 of the support part 2 is also formed on the first web 10. The second side surface 12 is again arranged to adjoin the first side surface 6, but it does not extend over the entire width of the support part 2. Instead, it forms only an end surface of the angle-shaped support part 2. To this extent, only a smaller contact surface is available for the window frame 34 in this embodiment.

The advantage of this embodiment, however, is that a sealing strip 42 made of a flexible foam of polyurethane, for example, which returns to its original shape after compression, can be arranged on a side of the insulating part 4 facing the window frame 34. This sealing strip 42 can expand against the window frame 34 and thus ensure a seal against the window frame 34. As a result, an additional seal like that shown in FIG. 2 can be omitted. The sealing strip 42 can, in addition, be held in the compressed state by a compression means 44, here a plastic sheet wrapper. The sealing strip 42 can be expanded at the construction site by detaching or removing the compression means 44.

The individual elements of the embodiments of FIGS. 1*a* and 4*a* can also be combined at any time to obtain new embodiments.

Figure 5:
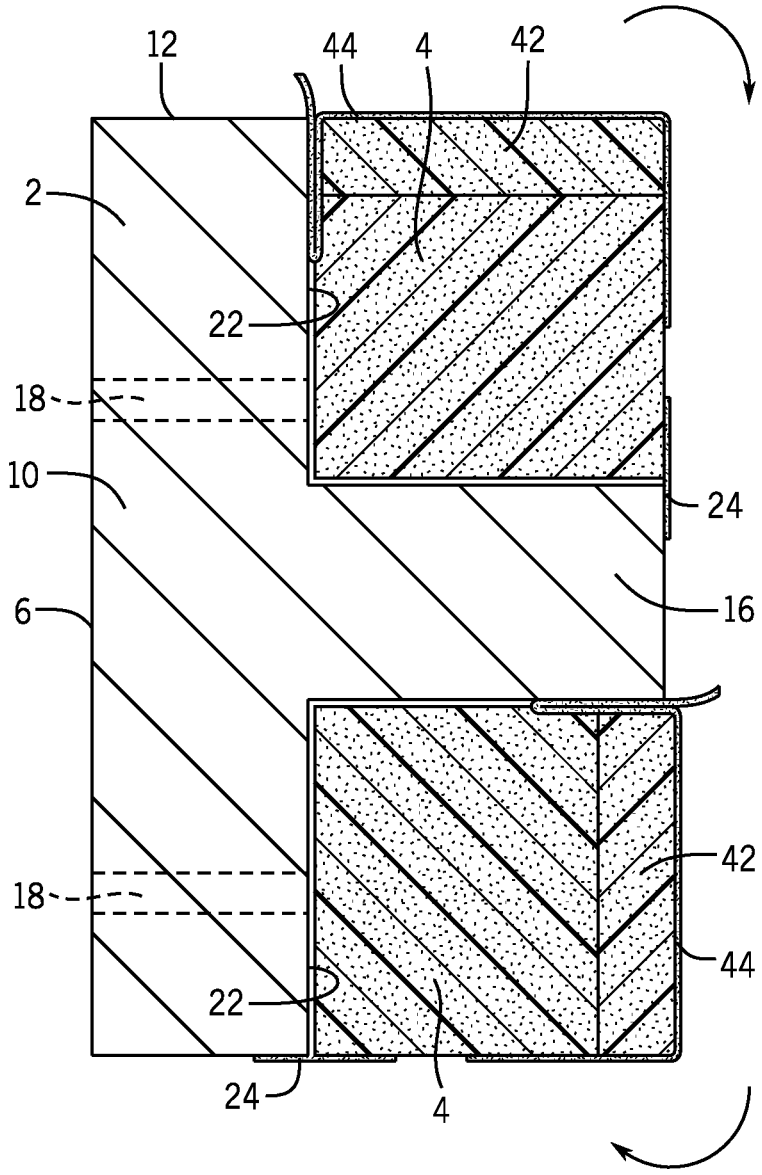
FIG. 5 is a cross-sectional view of another embodiment of the support and insulating element according to the invention.

FIG. 5 shows another embodiment of the support and insulating element according to the invention. Here the support part 2 is formed with a substantially T-shaped cross-section, and the support and insulating element comprises two insulating parts 4, one of which is arranged on each of the two sides of the second web 16 of the support part 2. If, as shown, the lower insulating part 4 is equipped with a sealing strip 42, this strip will, after expansion in the installed state, press against the outer wall 30 or against the alternative thermal insulation and ensure a seal at that point.

For the person skilled in the art, additional modifications, especially of the geometric arrangement of the support part 2 and the insulating part 4, are conceivable within the scope of the invention.

The invention claimed is:

1. A strip-shaped support and insulating element for supporting and insulating a window frame with respect to a main wall comprising:

a support part having (a) a first longitudinally-extending side surface engageable with the main wall and (b) a second longitudinally-extending side surface substantially perpendicular to the first side surface and supportingly engageable with the window frame, the support part being formed of a load-bearing material and including (a1) a first web that includes the first side surface and an inner side surface opposite the first side surface and (a2) a second web connected to and projecting at an angle substantially perpendicular from the first web to define an L-shaped cross section without any slanted surfaces; and an insulating part along the inner side surface of the first web and pivotably connected to an outer edge area of the first web of the support part such that the insulating part is pivotable between a working position exposing and an insulating position covering at least most of the inner side surface of the first web.

2. The support and insulating element of claim 1 wherein the second web is connected to the insulating part by a removable adhesive strip.

3. The support and insulating element of claim 1 wherein a sealing strip is arranged on a side of the insulating part facing away from the support part, the sealing strip being of a flexible foam that returns to its original shape after compression.

4. The support and insulating element of claim 3 wherein the sealing strip is held in a compressed state by a compression means such that expansion of the sealing strip can be initiated by loosening or removing the compression means.

5. The support and insulating element of claim 4 wherein the compression means is a plastic sheet wrapper at least partially surrounding the sealing strip.

6. The support and insulating element of claim 1 wherein a pivotable connection between the insulating part and the support part is formed by a flexible adhesive strip which is adhered to both the insulating part and the support part.

7. The support and insulating element of claim 1 wherein at least one through-hole extends through the first web from its inner side surface to its first side surface, thereby to accommodate a fastening element for fastening the support part to the main wall.

8. The support and insulating element of claim 1 wherein the support part is formed of a rigid foam material.

9. The support and insulating element of claim 1 wherein the insulating part is formed of a foam.

10. The support and insulating element of claim 9 wherein the insulating part is formed of a hard, flexible foam.

11. The support and insulating element of claim 1 wherein the second web includes the second side surface.

12. The support and insulating element of claim 1 wherein the first web of the support part also includes the second side surface, the second side surface adjoining the first side surface.

13. The support and insulating element of claim 1 wherein the insulating part has a substantially rectangular cross-section.

14. A building section comprising:

a main wall;

at least one support and insulating element including:

a support part having (a) a first longitudinally-extending side surface engageable with the main wall and (b) a second longitudinally-extending side surface substantially perpendicular to the first side surface and supporting engageable with a window frame, the support part being formed of a load-bearing material and including (a1) a first web that includes the first side surface and an inner side surface opposite the first side surface and (a2) a second web connected to and projecting at an angle from the first web to define an L-shaped cross section, and an insulating part along the inner side surface of the first web and pivotably connected to an outer edge area of the first web of the support part such that the insulating part is pivotable between a working position exposing and an insulating position covering at least most of the inner side surface of the first web, the support and insulating element being arranged on one side of the main wall and fastened to the main wall by means of at least one fastening element with the first side surface of the support part engaging the main wall; and a window frame supported at least partially on the second side surface of the support part.

* * * * *